US007778433B2

(12) United States Patent
Lee et al.

(10) Patent No.: US 7,778,433 B2
(45) Date of Patent: Aug. 17, 2010

(54) WIRELESS SYSTEM AND METHOD THEREOF FOR HEARING

(75) Inventors: John-See Lee, Hsinchu (TW); Chein-Wei Jen, Hsinchu (TW); Gin-Kou Ma, Hsinchu (TW); Li-Ren Huang, Taipei (TW)

(73) Assignee: Industrial Technology Research Institute, Hsinchu (TW)

( * ) Notice: Subject to any disclaimer, the term of this patent is extended or adjusted under 35 U.S.C. 154(b) by 1226 days.

(21) Appl. No.: 11/119,242

(22) Filed: Apr. 29, 2005

(65) Prior Publication Data

US 2006/0245608 A1 Nov. 2, 2006

(51) Int. Cl.
*H04R 25/00* (2006.01)

(52) U.S. Cl. ..... 381/315; 381/312; 455/575.2

(58) Field of Classification Search ..... 381/77, 381/315, 311, 312, 331; 455/68–69, 522, 455/575.2, 574

See application file for complete search history.

(56) References Cited

U.S. PATENT DOCUMENTS

| | | | | |
|---|---|---|---|---|
| 5,721,783 | A | 2/1998 | Anderson | |
| 5,774,791 | A | 6/1998 | Strohallen et al. | |
| 6,542,745 | B1 * | 4/2003 | Mottier et al. | 455/441 |
| 7,010,332 | B1 * | 3/2006 | Irvin et al. | 455/575.2 |
| 7,079,814 | B2 * | 7/2006 | Frantti et al. | 455/67.11 |
| 7,372,970 | B2 * | 5/2008 | Ach-Kowalewski | 381/322 |
| 7,389,088 | B2 * | 6/2008 | Kim | 455/41.1 |
| 2005/0100182 | A1 * | 5/2005 | Sykes et al. | 381/315 |
| 2007/0147641 | A1 * | 6/2007 | Platz | 381/315 |
| 2007/0249289 | A1 * | 10/2007 | Grafenberg et al. | 455/68 |
| 2009/0097683 | A1 * | 4/2009 | Burns et al. | 381/324 |

* cited by examiner

*Primary Examiner*—Curtis Kuntz
*Assistant Examiner*—Ryan Robinson
(74) *Attorney, Agent, or Firm*—Alston & Bird LLP

(57) ABSTRACT

A two-piece wireless hearing improvement system having a pocket piece and an earpiece, wherein the pocket piece includes a microphone adapted to receive analog signals, a first processor coupled to the microphone to convert the analog signals to digital signals, and a first transceiver coupled to the processor to transmit the digital signals. The earpiece includes a second transceiver for receiving the digital signals, a second processor coupled to the second transceiver for converting the digital signals to analog signals, a speaker coupled to the second processor for transmitting the analog signals, and a movement detector for detecting relative movements between the earpiece and the pocket piece and generating a first signal according to the relative movements. The first processor provides signal compensation based on the first signal.

22 Claims, 3 Drawing Sheets

Fig. 4
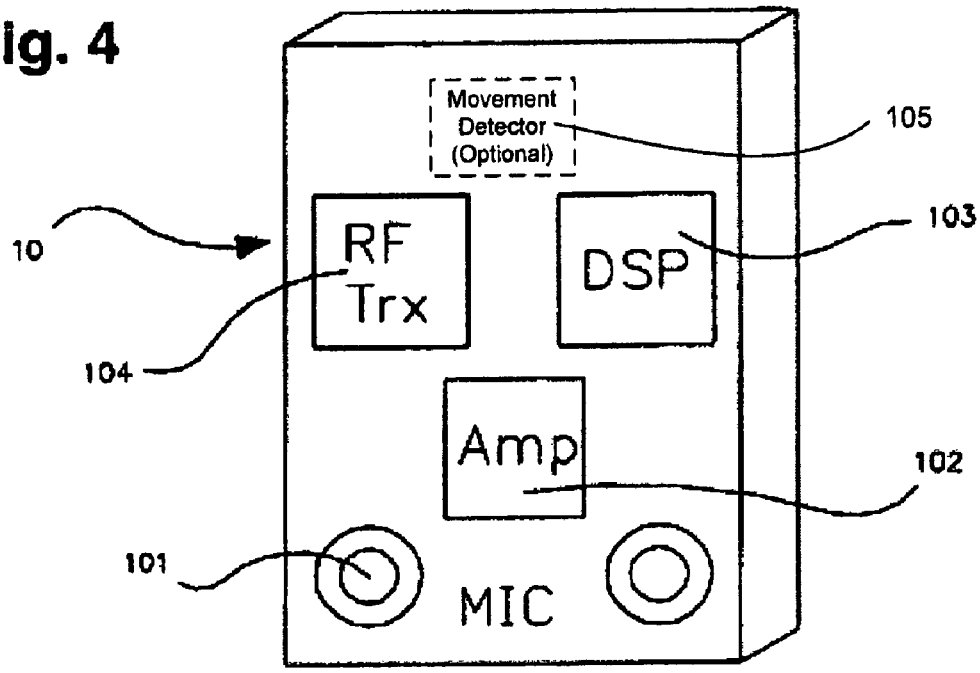
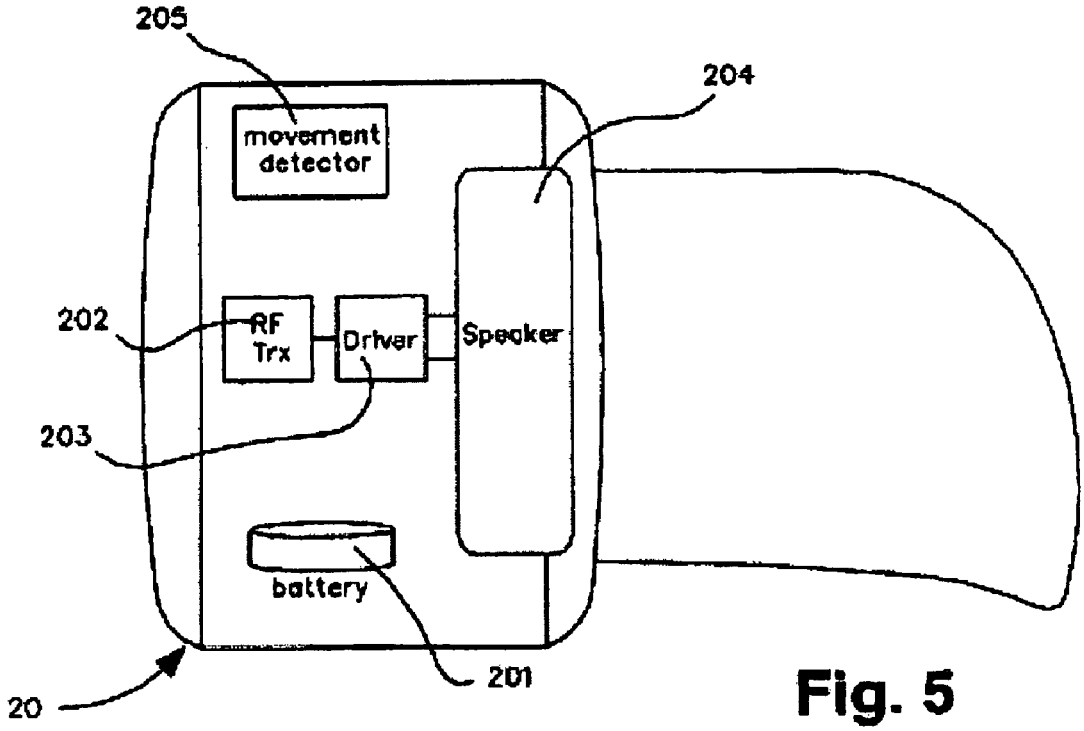
Fig. 5

WIRELESS SYSTEM AND METHOD THEREOF FOR HEARING

FIELD OF THE INVENTION

This invention pertains in general to wireless systems and methods thereof, and, more particularly, to two-piece systems and methods thereof for improving hearing.

BACKGROUND OF THE INVENTION

A hearing aid is generally a one-piece unit that integrates both a microphone and a speaker. The size of the hearing aid must also be small enough to fit into a human ear canal. Due to this size limitation, the performance of the single-piece hearing aid is curtailed by limited power supply. Furthermore, a number of algorithms capable of improving the functionality and performance of the single-piece hearing aid cannot be implemented in any commercial product.

Partly to address these limitations, a two-piece system has been proposed. Generally, a two-piece system includes a first piece, or "ear piece," having a microphone and a separate second piece, or "pocket piece," having a processor to process signals. As it is generally larger in size than the earpiece, the pocket piece may provide substantially more power to the entire hearing aid system and allow the implementation of complicated algorithms to process audio signals to enhance the performance of the system.

One such two-piece system has been described in U.S. Pat. No. 5,721,783 (the '783 patent). The '783 patent describes a two-piece hearing aid system comprising an earpiece and a processor unit. The earpiece includes a microphone, a first wireless reflective transponder, a first wireless receiver and a speaker transducer. The processor unit includes a second wireless receiver and a signal processor. According to the '783 patent, sounds from the environment are picked up by the microphone in the earpiece and sent, along with other information, over a two-way wireless link to the processor. The wireless link uses microwaves, and radar technology implements the wireless link to reduce earpiece size and power requirement.

Another exemplary two-piece system is described in U.S. Pat. No. 5,774,791 (the '791 patent). According to the '791 patent, a cordless headset, requiring low power using Time Variant Modulation (TVM) for reception of a magnetic signal is described. The headset area or zone of operations is defined by the magnetic field that the headset operates within and uses a handshake protocol that takes advantage of the TVM fixed clock period. The headset communicates with a base station that includes a TVM transmitter and loop for transmitting a TVM signal to the cordless headset, and an RF or infrared receiver capable of receiving TVM signals from the headset. The base station also incorporates headset protocol logic to control the headset transmission. The headset and base station receiver can both be fixed, mobile or portable and vary with respect to orientation and distance from each other. Both the '783 and '791 patents are incorporated herein by reference.

When the microphone is part of the earpiece, audio signals are first received by the microphone in the earpiece, and then transmitted to the processor in the pocket piece for processing. However, since the microphone also consumes power, the length of time the earpiece may be used without having to replenish the power source is decreased. In addition, the earpiece is subject to movements of a user's head, and therefore the signals received by the earpiece may be distorted and degraded.

BRIEF SUMMARY OF THE INVENTION

In accordance with the invention, there is provided a wireless hearing improvement system that includes a first piece and a second piece. The first piece includes a first power supply providing power for the first piece, a microphone adapted to receive analog signals, a first processor coupled to the microphone to convert the analog signals to digital signals, and a first transceiver coupled to the processor to transmit the digital signals. The second piece, in wireless communication with the first piece, includes a second power supply for providing power for the second piece, a second transceiver for receiving the digital signals, a second processor coupled to the second transceiver for converting the digital signals to analog signals, a speaker coupled to the second processor for transmitting the analog signals, and a movement detector for detecting relative movements between the first piece and the second piece and generating a first signal according to the relative movements of the first and second pieces. The first processor provides signal compensation based on the first signal.

Also in accordance with the present invention, there is provided a wireless hearing improvement system that includes a pocket piece having a first power supply providing power for the pocket piece, a first transceiver means for receiving analog signals, and a first processor means, coupled to the first transceiver means, for converting the analog signals to digital signals, wherein the first transceiver means transmits the digital signals. The system also includes an earpiece that includes a second power supply for providing power for the earpiece, a second transceiver means for receiving the digital signals, a second processor means, coupled to the second transceiver means, for converting the digital signals to analog signals, and a speaker means for transmitting the analog signals. The system additionally includes a movement detector for detecting relative movements between the earpiece and the pocket piece and generating a first signal according to the relative movements of the pocket piece and earpiece, wherein the pocket piece further comprises a means for signal compensation of transmission of signals between the earpiece and pocket piece based on the first signal.

Further in accordance with the present invention, there is provided a method of transmitting signals between a wireless hearing improvement system having a first piece and a second piece that includes receiving analog signals in the first piece, converting the analog signals to digital signals, and transmitting the digital signals to the second piece. The method also includes receiving the digital signals in the second piece, converting the received digital signals to analog signals, broadcasting the analog signals, generating a first signal indicating a relative movement between the first piece and the second piece, and compensating for transmission of signals between the first piece and the second piece based on the first signal.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings:

FIG. 4 illustrates a schematic view showing one embodiment of the pocket piece of the two-piece wireless hearing improvement system in accordance with another embodiment of the present invention; and FIG. 5 illustrates a schematic view showing one embodiment of the earpiece of the two-piece wireless hearing improvement system in accordance with another embodiment of the present invention.

DETAILED DESCRIPTION OF THE INVENTION

Reference will now be made in detail to the present embodiments of the invention, examples of which are illustrated in the accompanying drawings. Wherever possible, the same reference numbers will be used throughout the drawings to refer to the same or like parts.

The present invention is directed to a two-piece wireless hearing improvement system and a method thereof. The system includes a pocket piece and an earpiece. The pocket piece includes a first power supply to provide power to the pocket piece, a microphone adapted to receive audio signals or sounds, and an amplifier to magnify sounds received by the microphone. The pocket piece also includes a digital signal processor to convert the magnified sounds into digital signals, and a first transceiver electrically coupled to the digital signal processor to transmit at least the digital signals.

The earpiece includes a second power supply to provide electric power to the earpiece and a second transceiver to receive audio signals from the first transceiver. The earpiece also includes a driver to receive the digital signals from the second transceiver and convert the digital signals to analog signals, or sounds, and a speaker to transmit or broadcasts the sounds. The earpiece further includes a movement detector adapted to generate motion signals resulting from movements of the earpiece relative to the pocket piece. The second transceiver is adapted to transmit the motion signals to the pocket piece and the digital signal processor is adapted to provide signal compensation based on the received movement signals.

Figure 1:
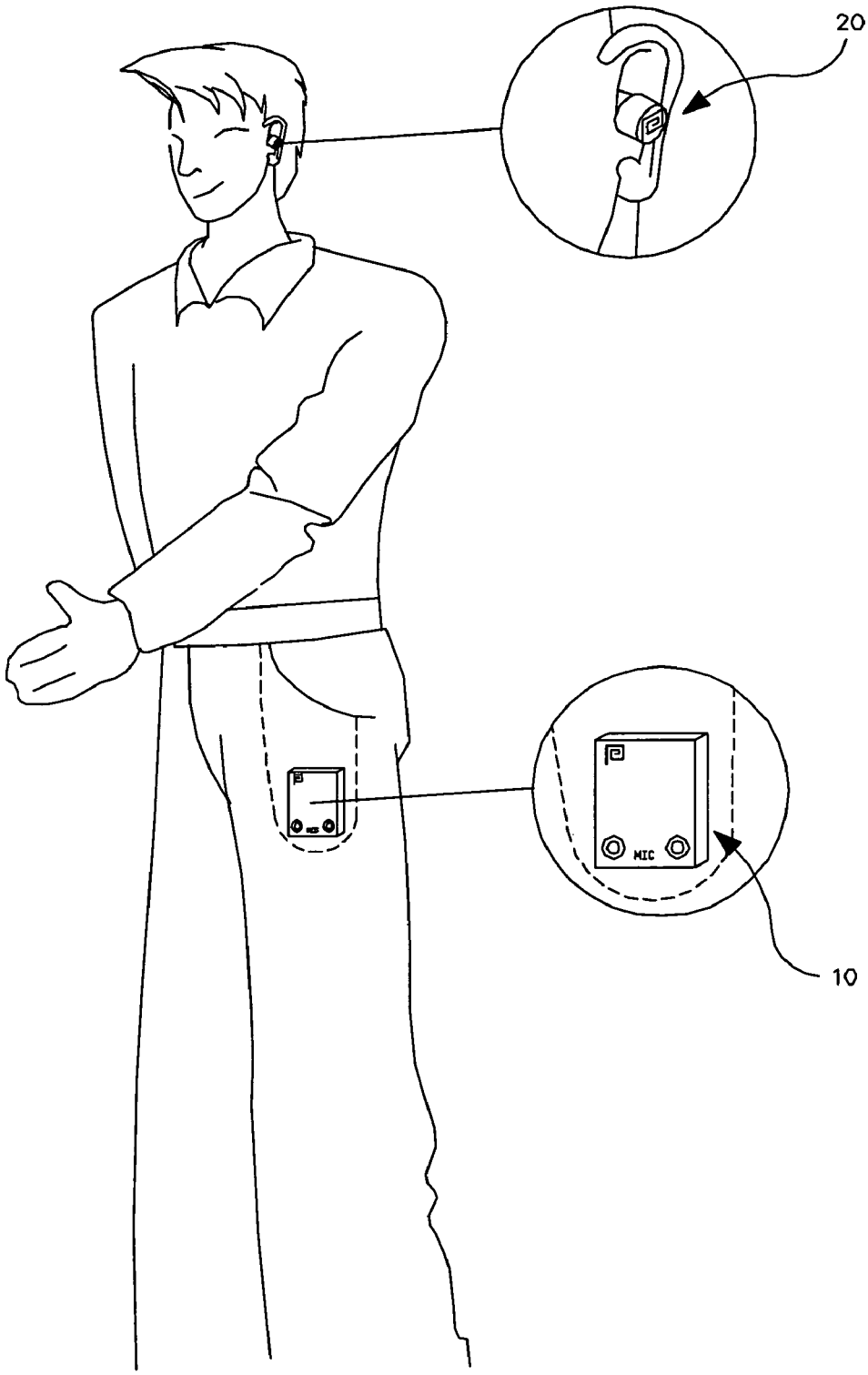
FIG. 1 illustrates a schematic view of a two-piece wireless hearing improvement system of the present invention as worn by a user.

FIG. 1 illustrates a schematic view of a two-piece wireless hearing improvement system of the present invention as worn by a user. Referring to FIG. 1, the system includes a pocket piece 10 and an earpiece 20. The earpiece is fitted into the ear canal of the user and the separate pocket piece, as its name suggests, may be carried in the pocket of the user. However, the pocket piece may be strategically secured to any part of the user's body, or may be carried in any container within close proximity of the earpiece.

Figure 2:
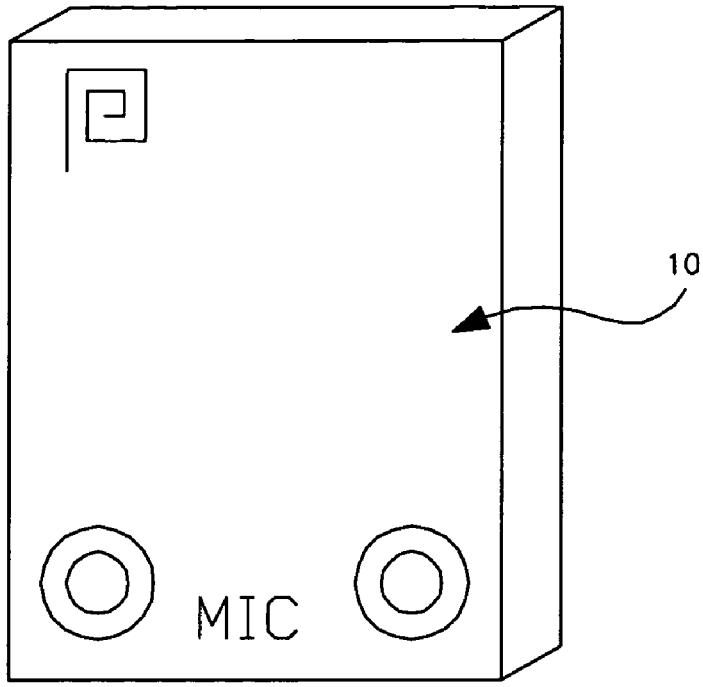
FIG. 2 is a perspective view of the pocket piece of the two-piece wireless hearing improvement system in accordance with one embodiment of the present invention.

FIG. 2 is a perspective view of the pocket piece of the two-piece wireless hearing improvement system of the present invention. FIG. 4 is the schematic view of the pocket piece of the hearing improvement system in accordance with one embodiment of the present invention. Referring to FIG. 4, the pocket piece 10 includes a first power supply (not shown), a microphone 101, an amplifier 102, a digital signal processor (DSP) 103, and a first transceiver 104. The first power supply provides electric power to the pocket piece 10 and can generally be a battery or other suitable power source. The microphone 101 is adapted to receive analog signals of any kind, including voices and ambient sounds.

The pocket piece 10 also includes an analog to digital (A/D) converter (not shown) to convert the analog signals received by the microphone 101 to digital signals. By way of example, the A/D converter may be implemented as a separate component coupled to the microphone 101, or integrated into the amplifier 102, which amplifies and converts analog signals into digital signals, or the DSP 103. The DSP 103 is coupled to the amplifier 102, and processes the magnified digital signals. The DSP 103 executes embedded firmware, or algorithms, directed to signal conversion and signal compensation, which will be discussed further in detail below. The first transceiver 104, coupled to the DSP 103, transmits the processed digital signals received from the DSP 103 to the earpiece 20. In one embodiment, the first transceiver 104 includes an RF transmitter.

Figure 3:
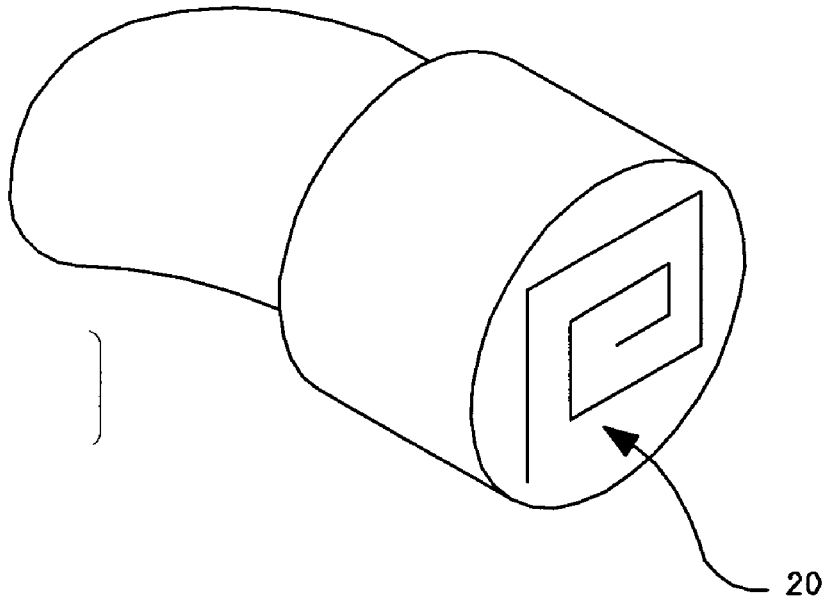
FIG. 3 is is a perspective view of the earpiece of the two-piece wireless hearing improvement system in accordance with one embodiment of the present invention.

FIG. 3 is a perspective view of the earpiece of the two-piece wireless hearing improvement system of the present invention. FIG. 5 is a schematic view of the earpiece of the hearing improvement system in accordance with one embodiment of the present invention. Referring to FIG. 5, the earpiece 20 includes a second power supply 201, a second transceiver 202, a driver 203, a speaker 204 and a movement detector 205. The second power supply 201, such as a battery pack, provides power to the earpiece 20. The second transceiver 202 receives the digital signals transmitted by the first transceiver 104 in the pocket piece 10. In one embodiment, the second transceiver 202 includes an RF receiver 202.

A digital to analog (D/A) converter (not shown), coupled to the second transceiver 202, converts the digital signals to analog signals, or sounds. In one embodiment, the D/A converter is integrated with the driver 203, which, in turn, is coupled to the second transceiver 202. The driver 203 is adapted to drive the analog signals. The speaker 204, coupled to the driver 203, broadcasts the sounds to a user's ear.

The earpiece 20 of the disclosure of the embodiment also may include the movement detector 205 adapted to detect movements of the earpiece 20, which reflect movements from the user's head, and generate signals representing movements of the earpiece 20 relative to the pocket piece 10. The second transceiver 202, coupled to the movement detector 205, transmits the signals generated by the movement detector 205 to the first transceiver 104. The digital signal processor (DSP) 103, coupled to the first transceiver 104, provides signal compensation based on the received signals from the movement detector 205. The movement detector discussed herein may also be implemented in the pocket piece 10 to detect the movement of the earpiece 20, as indicated at 105. The earpiece 20 may also be designed to be disposable as it includes relatively fewer components.

In operation, audio signals, or sounds, are first received by the microphone 101 in the pocket piece 10. The audio signals, analog in nature, are transmitted to the amplifier 102 where the analog signals can be magnified and converted to digital signals by the A/D converter. The digital signals are provided to the DSP 103 for further processing and coupled to the first transceiver 104 where the digital signals are wirelessly transmitted to the second transceiver 202 in the earpiece 20. The digital signals are then provided to the driver 203 and the D/A converter that converts the digital signals to analog signals, or sounds. The speaker 204 receives and broadcasts the analog signals.

Because the user's head, within which the earpiece 20 is located, often moves relative to the pocket piece 10, signal transmission between the earpiece 20 and the pocket piece 10 may be distorted or degraded. The movement detector 205 detects the movements of the earpiece 20 and generates corresponding signals to indicate any such movement. The signals generated by the movement detector 205 are provided to the second transceiver 202 to transmit the signals to the first transceiver 104, which, in turn, provides the signals to the DSP 103. In one embodiment, the DSP 103 includes firmware to compensate for signal distortion or degradation due to the movements of the earpiece 20 relative to the pocket piece 10. As such, the signals transmitted from the pocket piece 10 to the earpiece 20 are compensated to account for their relative movements, thereby ensuring the quality of audio signals, or sounds, received by the user.

The present invention is also directed to a method of transmitting signals between a wireless hearing improvement system. The method includes receiving analog signals in the pocket piece, amplifying the received analog signals, and converting the analog signals to digital signals. The digital signals are then transmitted to the earpiece. The method further includes receiving the digital signals in the earpiece, converting the received digital signals to analog signals and broadcasting the analog signals into the ear of the user. A first signal is also generated to indicate relative movements between the pocket piece and the earpiece, and signal distortion and degradation resulting from the movements of the earpiece relative to the pocket piece is compensated based on the first signal.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A wireless hearing improvement system, comprising:

a first piece including:

a first power supply configured to provide power for the first piece, a microphone configured to receive analog signals, a first processor coupled to the microphone and configured to convert the analog signals to digital signals, and a first transceiver coupled to the first processor and configured to transmit the digital signals; and a second piece, configured to wirelessly communicate with the first piece, including:

a second power supply configured to provide power for the second piece, a second transceiver configured to receive the digital signals, a second processor coupled to the second transceiver and configured to convert the digital signals to analog signals, and a speaker coupled to the second processor and configured to transmit the analog signals; and a movement detector configured to measure movement of the second piece reflecting a change in position of the second piece relative to the first piece, the movement detector being configured to generate a first signal in response to any measured movement of the second piece, the first signal being generated according to and being representative of the measured movement;

wherein the first processor is configured to receive the first signal and provide signal compensation based on the measured movement according to which the first signal is generated.

2. The system as claimed in claim 1, wherein the first signal is transmitted by the second transceiver and received by the first transceiver.

3. The system as claimed in claim 1, wherein the first transceiver includes an RF transmitter.

4. The system as claimed in claim 1, wherein the second transceiver includes an RF receiver.

5. The system as claimed in claim 1, wherein the first piece further comprises an amplifier coupled to the microphone to magnify the analog signals received by the microphone.

6. The system as claimed in claim 1, wherein the second piece further comprises a driver coupled to the second transceiver.

7. The system as claimed in claim 1, wherein the first processor comprises an analog to digital converter.

8. The system as claimed in claim 1, wherein the second processor comprises a digital to analog converter.

9. A wireless hearing improvement system, comprising:

a pocket piece including:

a first power supply for providing power for the pocket piece, a first microphone means for receiving analog signals, and a first processor means, coupled to a first transceiver means, for converting the analog signals to digital signals, and for transmitting the digital signals;

an earpiece including:

a second power supply for providing power for the earpiece, a second transceiver means for receiving the digital signals, a second processor means, coupled to the second transceiver means, for converting the digital signals to analog signals, and a speaker means for transmitting the analog signals; and a movement detector for measuring movement of the earpiece reflecting a change in position of the earpiece relative to the pocket piece, the movement detector also being for generating a first signal in response to any measured movement of the earpiece, the first signal being generated according to and being representative of the measured movement, wherein the pocket piece further comprises a means for receiving the first signal and performing signal compensation of transmission of signals between the earpiece and pocket piece in response to measured movement of the earpiece according to which the first signal is generated.

10. The system as claimed in claim 9, wherein the means for signal compensation includes firmware for generating signal compensation.

11. The system as claimed in claim 9, wherein first signal is transmitted by the second transceiver means and received by the first transceiver means.

12. The system as claimed in claim 9, wherein the first transceiver means includes an RF transmitter.

13. The system as claimed in claim 9, wherein the second transceiver means includes an RF receiver.

14. The system as claimed in claim 9, wherein the pocket piece further comprises an amplifier for amplifying received analog signals.

15. The system as claimed in claim 9, wherein the earpiece further comprises a driver coupled to the second transceiver.

16. The system as claimed in claim 9, wherein the movement detector is provided in the earpiece.

17. The system as claimed in claim 9, wherein the movement detector is provided in the pocket piece.

18. A method of transmitting signals between a wireless hearing improvement system having a first piece and a second piece, comprising:

receiving analog signals in the first piece;

converting the analog signals to digital signals;

transmitting the digital signals to the second piece;

receiving the digital signals in the second piece;

converting the received digital signals to analog signals;

broadcasting the analog signals;

measuring movement of the second piece reflecting a change in position of the second piece relative to the first piece, and generating a first signal in response to any measured movement of the second piece, the first signal being generated according to and being representative of the measured movement; and receiving the first signal and compensating for transmission of signals between the first piece and the second piece based on the measured movement according to which the first signal is generated.

19. The method as claimed in claim 18, further comprising amplifying the received analog signals.

20. The method as claimed in claim 18, further comprising driving the analog signals in the second piece.

21. The system as claimed in claim 1, wherein the second piece includes the movement detector.

22. The system as claimed in claim 1, wherein the first piece includes the movement detector.

* * * * *